US009213284B2

(12) United States Patent
Okabayashi et al.

(10) Patent No.: US 9,213,284 B2
(45) Date of Patent: Dec. 15, 2015

(54) IMAGE FORMING APPARATUS AND IMAGE FORMING METHOD FOR CORRECTING IMAGES ON A MEDIUM ACCORDING TO A TEMPERATURE

(71) Applicant: FUJI XEROX CO., LTD., Minato-ku, Tokyo (JP)

(72) Inventors: Yasuto Okabayashi, Kanagawa (JP); Yoshihiro Hayashi, Kanagawa (JP); Toshiyuki Miyata, Kanagawa (JP); Satoshi Nakamura, Kanagawa (JP); Yuhei Tomita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/329,577

(22) Filed: Jul. 11, 2014

(65) Prior Publication Data

US 2015/0277317 A1 Oct. 1, 2015

(30) Foreign Application Priority Data

Mar. 25, 2014 (JP) ..... 2014-062518

(51) Int. Cl.
*G03G 15/20* (2006.01)
*G03G 15/00* (2006.01)
*G03G 21/20* (2006.01)

(52) U.S. Cl.
CPC ..... *G03G 15/2064* (2013.01); *G03G 15/2046* (2013.01); *G03G 15/50* (2013.01); *G03G 21/20* (2013.01); *G03G 2215/2045* (2013.01)

(58) Field of Classification Search
CPC ..... G03G 15/2046; G03G 21/20; G03G 2215/2045
USPC ..... 399/44, 45, 68, 320, 328, 335; 219/216
See application file for complete search history.

(56) References Cited

U.S. PATENT DOCUMENTS

| | | | | |
|---|---|---|---|---|
| 6,390,696 | B1 * | 5/2002 | Concannon | 400/120.01 |
| 8,090,279 | B2 * | 1/2012 | Ishikuro | 399/44 |
| 2003/0002881 | A1 * | 1/2003 | Hirose et al. | 399/44 |
| 2004/0165897 | A1 * | 8/2004 | Hooper et al. | 399/44 |

FOREIGN PATENT DOCUMENTS

| | | | |
|---|---|---|---|
| JP | 09237013 | A * | 9/1997 |
| JP | 4097406 | B2 | 6/2008 |
| JP | 2009109874 | A * | 5/2009 |
| JP | 4310098 | B2 | 8/2009 |

* cited by examiner

*Primary Examiner* — Robert Beatty
(74) *Attorney, Agent, or Firm* — Sughrue Mion, PLLC

(57) ABSTRACT

An image forming apparatus includes a transport unit that transports plural recording media having developer images transferred thereon, at an interval; a fixing unit that fixes the developer images to the recording media transported by the transport unit, by applying heat; a temperature measuring unit that measures an ambient temperature; a speed changing unit that decreases a fixing speed of the developer images in the fixing unit if the ambient temperature measured by the temperature measuring unit is a preset temperature or lower, as compared with the fixing speed if the ambient temperature is higher than the preset temperature; and an interval changing unit that decreases the interval if the ambient temperature is the preset temperature or lower, as compared with the interval if the ambient temperature is higher than the preset temperature.

5 Claims, 9 Drawing Sheets

FIG. 8

| | THIS EXEMPLARY EMBODIMENT | | | COMPARATIVE EXAMPLE |
|---|---|---|---|---|
| AMBIENT TEMPERATURE | 18°C OR HIGHER | LOWER THAN 18°C | | LOWER THAN 18°C |
| BASIS WEIGHT | 300 gsm OR SMALLER | 176 gsm OR SMALLER | 177 TO 300 gsm | 300 gsm OR SMALLER |
| NORMAL PAPER | 100 (SHEETS/MINUTE) | 100 (SHEETS/MINUTE) | 100 (SHEETS/MINUTE) | 90 (SHEETS/MINUTE) |
| COATED PAPER | 100 (SHEETS/MINUTE) | 100 (SHEETS/MINUTE) | 80 (SHEETS/MINUTE) | 70 (SHEETS/MINUTE) |
| OHP SHEET | 40 (SHEETS/MINUTE) | 40 (SHEETS/MINUTE) | 40 (SHEETS/MINUTE) | 35 (SHEETS/MINUTE) |

IMAGE FORMING APPARATUS AND IMAGE FORMING METHOD FOR CORRECTING IMAGES ON A MEDIUM ACCORDING TO A TEMPERATURE

CROSS-REFERENCE TO RELATED APPLICATIONS

This application is based on and claims priority in 35 USC 119 from Japanese Patent Application No. 2014-062518 filed Mar. 25, 2014.

BACKGROUND

The present invention relates to an image forming apparatus and an image forming method.

SUMMARY

According to an aspect of the invention, there is provided an image forming apparatus including a transport unit that transports plural recording media having developer images transferred thereon, at an interval; a fixing unit that fixes the developer images to the recording media transported by the transport unit, by applying heat; a temperature measuring unit that measures an ambient temperature; a speed changing unit that decreases a fixing speed of the developer images in the fixing unit if the ambient temperature measured by the temperature measuring unit is a preset temperature or lower, as compared with the fixing speed if the ambient temperature is higher than the preset temperature; and an interval changing unit that decreases the interval if the ambient temperature is the preset temperature or lower, as compared with the interval if the ambient temperature is higher than the preset temperature.

BRIEF DESCRIPTION OF THE DRAWINGS

Exemplary embodiments of the present invention will be described in detail based on the following figures, wherein:

FIG. 8 is a table showing productivity in respective conditions of the ambient temperature, basis weight, and sheet type, in the image forming apparatus according to the first exemplary embodiment, together with a comparative example;

DETAILED DESCRIPTION

First Exemplary Embodiment

An example of an image forming apparatus according to a first exemplary embodiment is described.

General Configuration

Figure 1:
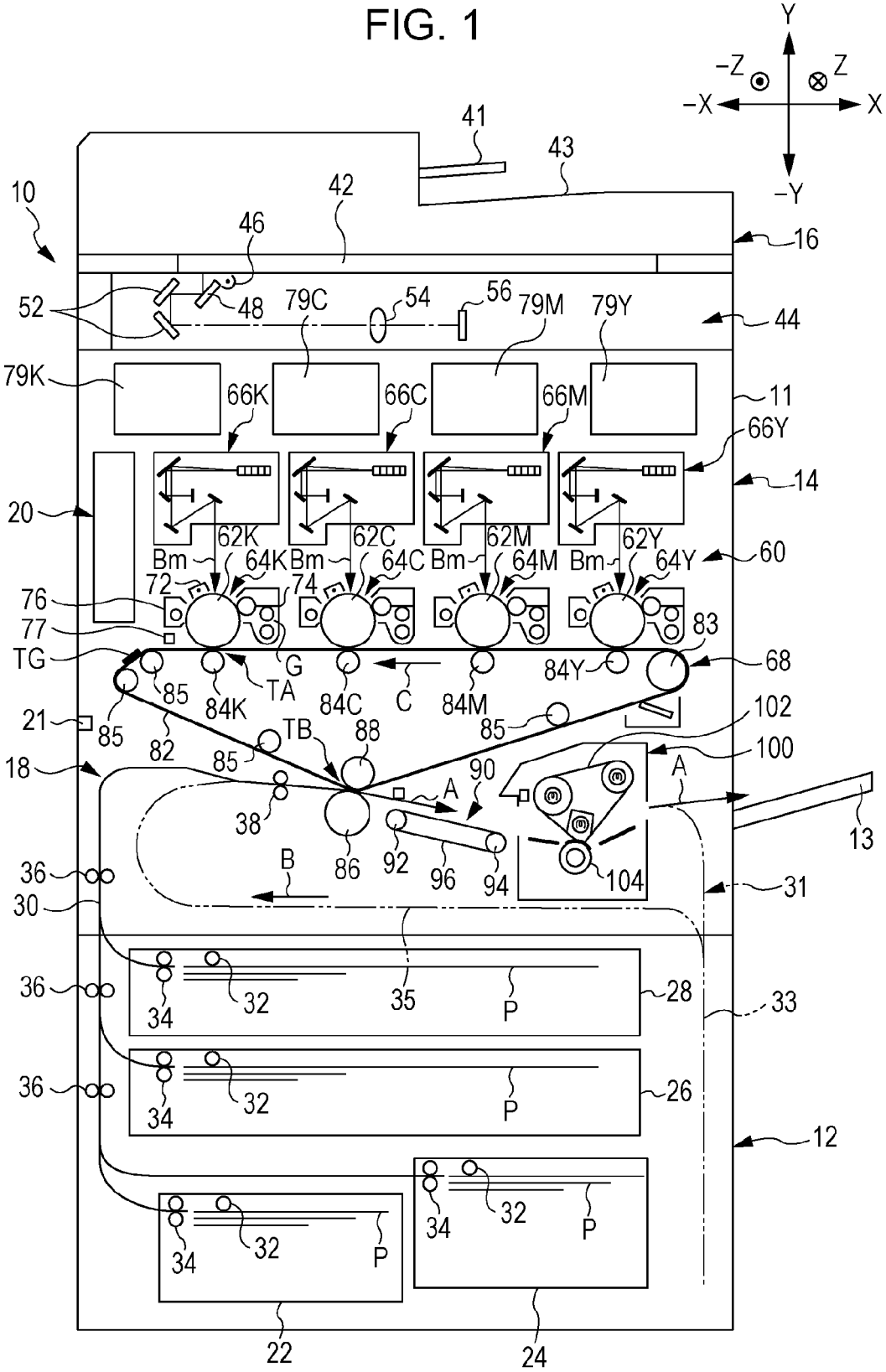
FIG. 1 is a general configuration diagram of an image forming apparatus according to a first exemplary embodiment.

FIG. 1 shows an image forming apparatus 10 as an example of the first exemplary embodiment. In the following description, the arrow Y direction (Y direction) is the height direction, and the direction orthogonal to the Y direction and indicated by arrow X (X direction) is the width direction in FIG. 1. Also, the direction orthogonal to the Y direction and X direction (Z direction) is the depth direction. Further, if one side and the other side of each of the X direction, Y direction, and Z direction are required to be distinguished from each other, the upper side is the Y side, the lower side is the −Y side, the right side is the X side, the left side is the −X side, the far side is the Z side, and the near side is the −Z side, in front view of the image forming apparatus 10 (view along the Z direction). The Y direction is the vertical direction.

The image forming apparatus 10 includes an apparatus body 11 serving as a housing formed of plural frame members. Also, the image forming apparatus 10 includes a sheet housing unit 12 that houses a sheet P as an example of a recording medium, a main operation unit 14 that forms an image on the sheet P, and a document reading unit 16 that reads a document (not shown). Further, the image forming apparatus 10 includes a feed unit 18 that feeds the sheet P to the respective units, a controller 20 that is provided in the main operation unit 14 and controls operations of the respective units of the image forming apparatus 10, and an operation panel 19 (see FIG. 3) with which various information is input. The controller 20 is an example of a speed changing unit and an interval changing unit.

Sheet Housing Unit

The sheet housing unit 12 includes a first housing part 22, a second housing part 24, a third housing part 26, and a fourth housing part 28 that may house sheets P of different types (including sizes, basis weights, and materials). The first housing part 22, the second housing part 24, the third housing part 26, and the fourth housing part 28 each include a send roller 32 that sends the housed sheets P one by one, and a transport roller 34 that transports the sent sheet P to a transport path 30 arranged in the image forming apparatus 10. In this exemplary embodiment, the sheet P even includes an OHP sheet.

Feed Unit

The feed unit 18 is arranged in a downstream portion of the transport path 30 with respect to the transport roller 34, and includes plural transport rollers 36 that transports the sheets P one by one. Further, a registration roller 38, as an example of the interval changing unit, is provided downstream of the transport rollers 36 in a transport direction of the sheet P.

Figure 3:
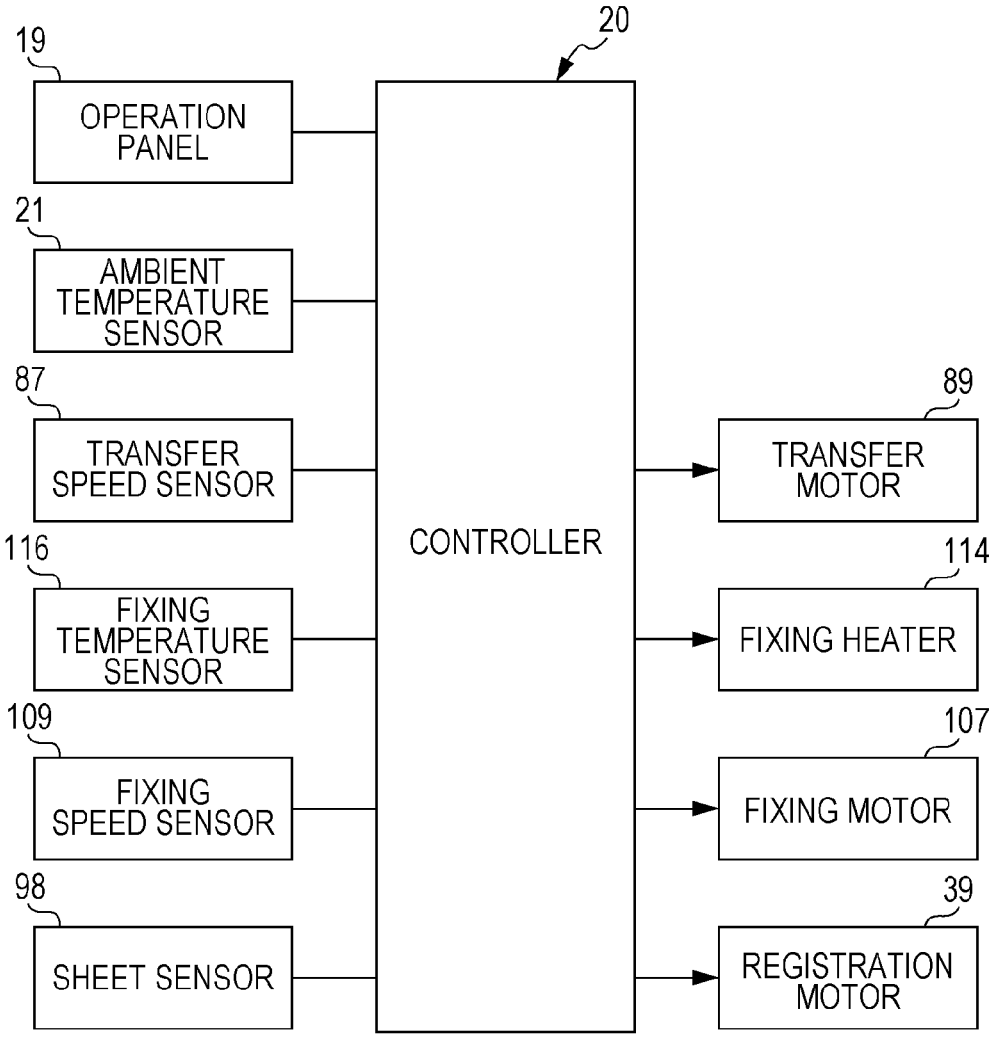
FIG. 3 is a block diagram showing a controller and respective units connected with the controller according to the first exemplary embodiment.

The registration roller 38 is driven by a registration motor 39 (see FIG. 3). The rotation operation and stop operation of the registration motor 39 are controlled by the controller 20. The registration roller 38 executes registration for transferring an image (described later) and changes a transport interval L1 (see FIG. 6A, described later) of the sheet P by temporarily stopping the sheet P and sends the sheet P to a second transfer position TB in association with the movement of an intermediate transfer belt 82. The registration motor 39 is an example of the interval changing unit.

The upstream portion of the transport path 30 extends straight in the arrow Y direction from the −X side of the sheet housing unit 12 to the lower portion at the −X side of the main operation unit 14 in front view of the image forming apparatus 10. Also, the downstream portion of the transport path 30 extends from the lower portion at the −X side of the main operation unit 14 to a sheet output part 13 provided at the lower portion at the X side of the main operation unit 14. Further, a duplex transport path 31 is connected to the transport path 30. The sheet P is transported and reversed in the duplex transport path 31 for image formation on both surfaces of the sheet P. The transport direction of the sheet P when the duplex transport is not executed is indicated by arrow A.

The duplex transport path 31 includes a reverse part 33 that reverses the sheet P and a send part 35 that sends the reversed sheet P to the transport path 30. The reverse part 33 extends straight in the arrow Y direction from the lower portion at the X side of the main operation unit 14 to the X side of the sheet housing unit 12 in front view of the image forming apparatus 10. The send part 35 is provided at the bottom of the main operation unit 14. The trailing edge of the sheet P transported to the reverse part 33 enters the send part 35, and the send part 35 sends the sheet P to the transport path 30. The transport direction of the sheet P in the sent part 35 is indicated by arrow B.

The downstream end portion of the send part 35 is connected to the transport path 30 at the upstream side of the registration roller 38 by a guide member (not shown). In FIG. 1, a switch member that switches the path between the transport path 30 and the duplex transport path 31, and a switch member that switches the path between the reverse part 33 and the send part 35 are not illustrated.

Document Reading Unit

The document reading unit 16 includes a document tray 41 on which plural documents (not shown) are placed, a platen glass 42 on which a single document is placed, a document reading device 44 that reads the document placed on the platen glass 42, and a document output part 43 to which the read document is output.

The document reading device 44 includes a light irradiation unit 46 that irradiates the document placed on the platen glass 42 with light, and a single full-rate mirror 48 and two half-rate mirrors 52 that cause reflection light reflected from the document to be reflected and folded back in a direction parallel to the platen glass 42. Further, the document reading device 44 includes an imaging lens 54 on which the reflection light folded back by the full-rate mirror 48 and the half-rate mirror 52 enters, and a photoelectric conversion element 56 that converts the reflection light focused by the imaging lens 54 into an electric signal.

The electric signal converted by the photoelectric conversion element 56 is image-processed by an image processing device (not shown), and is used for image formation. Also, the full-rate mirror 48 moves by full rate along the platen glass 42, and the half-rate mirrors 52 move by half rate along the platen glass 42.

Operation Panel

The operation panel 19 shown in FIG. 3 includes a touch panel (not shown). With this touch panel, various setting, such as the basis weight, material, and size of the sheet P, use or non-use of other recording medium, the number of image forming sheets, and execution or non-execution of duplex image formation, is made. Also, various information set (input) with the operation panel 19 is set to the controller 20.

Main Operation Unit

The main operation unit 14 shown in FIG. 1 includes an image forming device 60 that forms a toner image TG as an example of a developer image on a sheet P, and a fixing device 100 as an example of a fixing unit that fixes the toner image TG formed on the sheet P by the image forming device 60 to the sheet P by heat and pressure. Also, the main operation unit 14 includes an ambient temperature sensor 21 as an example of a temperature measuring unit.

Ambient Temperature Sensor

The ambient temperature sensor 21 has a measurement surface (not shown) that is exposed to the outside of the apparatus body 11, so that the ambient temperature sensor 21 measures the temperature outside the image forming apparatus 10 (hereinafter, referred to as ambient temperature). Also, the ambient temperature sensor 21 measures, for example, the humidity outside the image forming apparatus 10. The temperature information and humidity information measured by the ambient temperature sensor 21 is sent to the controller 20.

Image Forming Device

The image forming device 60 includes image forming units 64Y, 64M, 64C, and 64K respectively having image holding members 62Y, 62M, 62C, and 62K corresponding to respective toners of yellow (Y), magenta (M), cyan (C), and black (K). The image forming device 60 also includes exposure units 66K, 66C, 66M, and 66Y that emit light beams Bm to the outer peripheral surfaces of the image holding members 62K, 62C, 62M, and 62Y and hence expose the outer peripheral surfaces of the image holding members 62K, 62C, 62M, and 62Y to light. Further, the image forming device 60 includes a transfer unit 68 that transfers toner images TG formed by the image forming units 64K, 64C, 64M, and 64Y on a sheet P.

In the following description, if Y, M, C, and K are required to be distinguished from each other, description is given while adding any of the alphabetical characters of Y, M, C, and K after the number. For the similar configurations, if Y, M, C, and K are not required to be distinguished from each other, the indication of Y, M, C, and K is omitted.

The exposure unit 66 emits the light beam Bm corresponding to the toner of each color to the image holding member 62 by providing scanning with the light beam Bm emitted from a light source (not shown) with use of a polygonal mirror (reference sign omitted), and by reflecting the light beam Bm by plural optical components including a reflection mirror. Also, the image holding member 62 is provided at the −Y side of the exposure unit 66.

The image forming unit 64 includes the image holding member 62 being columnar and rotatable, and a charging unit 72, a developing unit 74, and a cleaning member 76 arranged in that order from the upstream side to the downstream side in the rotation direction of the image holding member 62 to face the outer peripheral surface of the image holding member 62. The charging unit 72 and the developing unit 74 are arranged so that the light beam Bm is emitted on the outer peripheral surface of the image holding member 62, at a position between the charging unit 72 and the developing unit 74. Also, the intermediate transfer belt 82 (described later) contacts the outer peripheral surface of the image holding member 62, at a position between the developing unit 74 and the cleaning member 76.

The image holding member 62 is rotatable by driving of a motor (not shown). The charging unit 72 is formed of, for example, a corotron charging unit that charges the outer peripheral surface of the image holding member 62 to have the same polarity as that of the toner by corona discharge by applying a voltage to a wire. The outer peripheral surface of the charged image holding member 62 is irradiated with the light beam Bm in accordance with image data, and hence a latent image (electrostatic latent image) is formed.

The developing unit 74 houses a developer G in which carrier particles made of a magnetic substance are mixed with a minus-charged toner, and has a cylindrical developing sleeve in which a magnet roller (not shown) having plural magnetic poles in the peripheral direction is provided. In the developing unit 74, when the developing sleeve rotates, a magnetic brush is formed at a portion where the developing unit 74 faces the image holding member 62.

Further, the developing unit 74 forms the toner image TG (developer image) by causing the latent image on the outer peripheral surface of the image holding member 62 to appear because a developing bias is applied to the developing sleeve by a voltage applying unit (not shown). A toner is fed to each developing unit 74 from a corresponding toner cartridge 79 provided above the image forming device 60.

The cleaning member 76 includes a cleaning blade that contacts the outer peripheral surface of the image holding member 62. The cleaning blade scrapes the toner remaining on the outer peripheral surface of the image holding member 62 and the cleaning member 76 collects the scraped toner. Also, the intermediate transfer belt 82 is provided downstream of the developing unit 74 in the rotation direction of the image holding member 62. The toner image developed by the developing unit 74 is first-transferred on the intermediate transfer belt 82.

The transfer unit 68 includes the endless intermediate transfer belt 82, a first transfer roller 84 that first-transfers the toner image from each image holding member 62 on the intermediate transfer belt 82, and a second transfer roller 86 that second-transfers the toner images TG superposed on the intermediate transfer belt 82 on a sheet P. The second transfer roller 86 is, for example, arranged outside the intermediate transfer belt 82. The second transfer roller 86 and an auxiliary roller 88, which is arranged inside the intermediate transfer belt 82, pinch the intermediate transfer belt 82. It is assumed that a position at which the intermediate transfer belt 82 is pinched between the image holding member 62 and the first transfer roller 84 is a first transfer position TA, and a position at which the intermediate transfer belt 82 is pinched between the second transfer roller 86 and the auxiliary roller 88 is the second transfer position TB.

A driving roller 83 that is rotationally driven, and plural transport rollers 85 that are rotatably provided are arranged inside the intermediate transfer belt 82. The intermediate transfer belt 82 is wound around the first transfer rollers 84K, 84C, 84M, and 84Y, the driving roller 83, the transport rollers 85, and the auxiliary roller 88. Accordingly, when the driving roller 83 rotates counterclockwise in the drawing, the intermediate transfer belt 82 moves in a circulation manner in a direction indicated by arrow C (counterclockwise).

The driving roller 83 is driven by a transfer motor 89 (see FIG. 3). The rotation operation and stop operation of the transfer motor 89 are controlled by the controller 20. If the transport interval L1 (see FIG. 6A, described later) of the sheets P is changed, the controller 20 changes the moving speed of the intermediate transfer belt 82 in accordance with the transport interval L1. The moving speed of the intermediate transfer belt 82 is a process speed when the toner image TG is transferred on the sheet P. Also, the driving roller 83 and the transfer motor 89 are examples of the interval changing unit.

To be specific, a transfer speed sensor 87 (see FIG. 3) that measures the moving speed of the intermediate transfer belt 82 is provided outside the intermediate transfer belt 82. The transfer speed sensor 87 is, for example, a reflection optical sensor including a pair of a light-emitting unit and a light-receiving unit (not shown). Also, the transfer speed sensor 87 irradiates reflective members (not shown), which are fixed to the outer peripheral surface of the intermediate transfer belt 82, with light, and measures the time between first-time reception of light from the reflective member and second-time reception of light from the reflective member.

Herein, by dividing the arrangement interval (distance) of the reflective members by the measured time, the moving speed of the intermediate transfer belt 82 is measured. Also, the controller 20 changes the rotating speed of the transfer motor 89 (the moving speed of the intermediate transfer belt 82) so that the moving speed measured by the transfer speed sensor 87 and the preset moving speed approaches to 0. The transport interval L1 (see FIG. 6A) is a distance from the trailing edge of a certain sheet P to the leading edge of the next sheet P in the transport direction of the sheets P. Also, the moving speed of the intermediate transfer belt 82 at the first transfer position TA and the second transfer position TB is called transfer speed.

The first transfer roller 84 has, for example, a configuration in which an elastic layer (not shown) is formed around a columnar shaft made of metal such as stainless steel. Both ends of the shaft are supported by bearings and hence the first transfer roller 84 is rotatable. Also, a voltage (positive voltage) having the reversed polarity reversal to the polarity of the toner is applied to the shaft of the first transfer roller 84 from a power supply (not shown).

The second transfer roller 86 has a configuration similar to that of the first transfer roller 84. The second transfer roller 86 is arranged downstream of the registration roller 38 on the transport path 30, and is rotatably provided. Also, the second transfer roller 86 contacts the outer peripheral surface of the intermediate transfer belt 82 at the aforementioned second transfer position TB.

Also, the second transfer roller 86 is grounded. The auxiliary roller 88 forms a counter electrode of the second transfer roller 86. A second transfer voltage is applied to the auxiliary roller 88 through a power supply roller (not shown) made of metal and arranged in contact with the outer peripheral surface of the auxiliary roller 88. When the second transfer voltage (negative voltage) is applied to the auxiliary roller 88 and a potential difference is generated between the auxiliary roller 88 and the second transfer roller 86, the toner image TG on the intermediate transfer belt 82 is second-transferred on the sheet P transported to the second transfer position TB.

A home position sensor (not shown) is provided outside the intermediate transfer belt 82. The home position sensor generates a reference signal serving as the reference for synchronization of the image formation timings of the image forming units 64Y, 64M, 64C, and 64K. This reference sensor generates the reference signal when recognizing a mark provided on the back surface of the intermediate transfer belt 82. The image forming units 64Y, 64M, 64C, and 64K start image formation in response to an instruction from the controller 20 based on the recognition of this reference signal. Also, an image density sensor 77 is provided downstream of the image forming unit 64K. The image density sensor 77 adjusts the image quality (for example, color correction) of the toner image TG.

A transport unit 90 is provided downstream of the second transfer roller 86 (second transfer position TB) in the moving direction of the sheet P. The transport unit 90 serves as an example of a transport unit that transports the sheet P after the second transfer of the toner image TG is completed, to the fixing device 100.

In the image forming apparatus 10, if the transport interval L1 (see FIG. 6A) of the sheets P is decreased, the process speed in the image forming device 60 is increased, and the send timing of the sheet P to the second transfer position TB by the registration roller 38 is advanced. In contrast, in the image forming apparatus 10, if the transport interval L1 of the sheets P is increased, the process speed in the image forming device 60 is decreased, and the send timing of the sheet P to the second transfer position TB by the registration roller 38 is delayed.

Configuration of Major Section

Next, the transport unit 90, the fixing device 100, and the controller 20 are described.

Transport Unit

Figure 2:
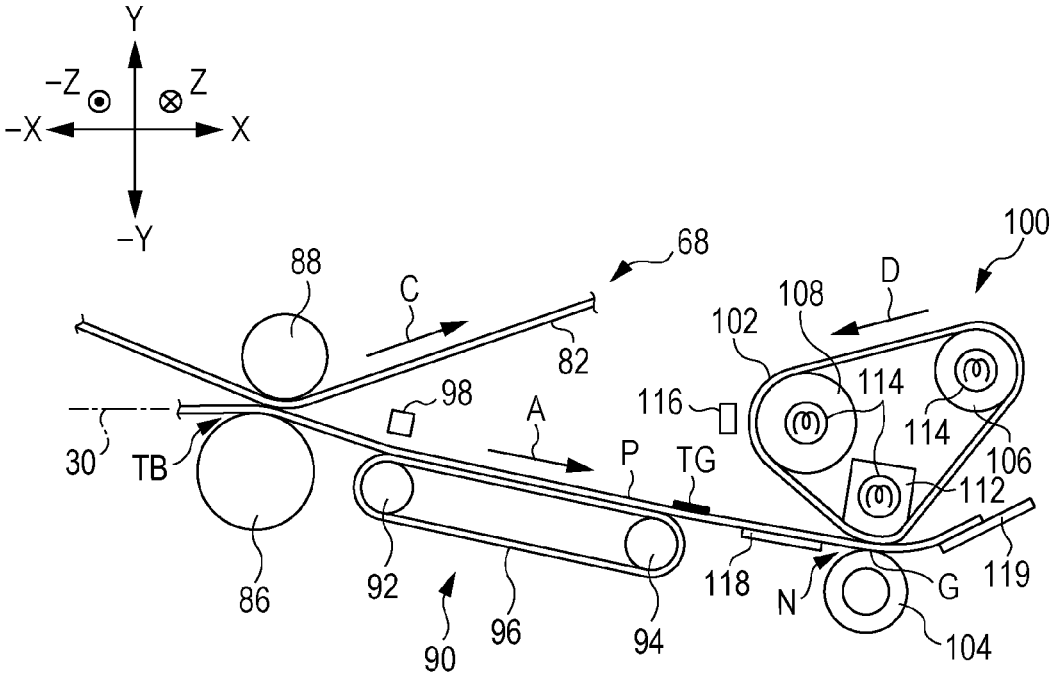
FIG. 2 is an explanatory view showing a configuration from a second transfer position to a fixing position according to the first exemplary embodiment.

As shown in FIG. 2, the transport unit 90 includes a support roller 92, a driving roller 94, a transport belt 96 wound around the support roller 92 and the driving roller 94, a sheet sensor 98 that detects a sheet P, and a suction unit (not shown). The support roller 92 and the driving roller 94 are provided at an interval in the transport direction (arrow A direction) of the sheet P, and are provided rotatably while the Z direction defines the axial direction. Also, the rotation operation and stop operation of the driving roller 94 are controlled by the controller 20 (see FIG. 1). To be specific, the driving roller 94 is controlled so that the transport speed of the sheet P by the transport belt 96 is equal to the transport speed of the sheet P by a fixing belt 102 (described later).

The transport belt 96 has plural through holes (not shown) penetrating therethrough in the thickness direction. The suction unit (not shown) is provided inside the transport belt 96. Hence, the inside of the through holes becomes the negative-pressure state when the suction unit performs the suction operation. The sheet P is transported to the fixing device 100 while being sucked to the outer peripheral surface of the rotating transport belt 96. If continuous image formation is performed, plural sheets P are transported by the transport unit 90 at the aforementioned transport interval.

The sheet sensor 98 is provided, for example, at a position between the second transfer position TB and a fixing position Q (described later) on the transport path 30, at the Y side of the support roller 92 and the transport belt 96, at a position facing a center portion in the Z direction of the transport belt 96. Also, the sheet sensor 98 is, for example, a reflection optical sensor including a pair of a light-emitting unit and a light-receiving unit (not shown). The sheet sensor 98 detects the presence of the sheet P in accordance with reception or non-reception of light by the light-receiving unit. Further, the sheet sensor 98 sends the information indicative of the detected sheet presence to the controller 20 (see FIG. 3).

Fixing Device

As shown in FIG. 2, the fixing device 100 includes, for example, the fixing belt 102 that fixes the toner image TG transferred (formed) on the sheet P, and a pressure roller 104 that presses the sheet P to the fixing belt 102. The transport speed of the sheet P at a nip part N (described later) is called fixing speed.

The fixing belt 102 is, for example, an endless belt made of polyimide. Two roller members 106 and 108 that are rotatable while the Z direction defines the axial direction, and a pad member 112 are provided inside the fixing belt 102. The pad member 112 is provided at a position facing the pressure roller 104 with the fixing belt 102 interposed therebetween. Also, the fixing belt 102 is wound around the roller members 106 and 108, and the pad member 112.

The roller member 106 is rotationally driven in the shown arrow D direction by a fixing motor 107 (see FIG. 3) as an example of the speed changing unit. Also, the peripheral velocity of the roller member 106 (peripheral velocity of the fixing belt 102) is measured by a fixing speed sensor 109 (see FIG. 3). The controller 20 (see FIG. 3) controls the rotation operation of the fixing motor 107 so that the peripheral velocity of the fixing belt 102 becomes a preset speed based on fixing speed information sent from the fixing speed sensor 109. The fixing speed sensor 109 measures the fixing speed by using, for example, a rotary encoder.

The roller members 106 and 108, and the pad member 112 include respective fixing heaters 114 therein. The fixing heaters 114 each include, for example, a halogen lamp. Also, a fixing temperature sensor 116 that measures the temperature of the fixing belt 102 is provided at a position facing the roller member 108 with the fixing belt 102 interposed therebetween. The fixing temperature sensor 116 is, for example, a non-contact (infrared detection) temperature sensor. The temperature of the fixing belt 102 measured by the fixing temperature sensor 116 is sent to the controller 20 (see FIG. 3). The controller 20 controls heating or stop of heating by the fixing heater 114 based on the difference between the temperature information from the fixing temperature sensor 116 and the preset temperature.

The pressure roller 104 has, for example, a configuration in which an elastic layer made of silicone rubber and a release layer made of fluorocarbon resin are laminated on the outer peripheral surface of a cylindrical core metal made of aluminum. In the following description, a part of the fixing belt 102 pinched between the pad member 112 and the pressure roller 104 and receiving a load is called nip part (contact part) N. Also, the center position of the nip part N in the transport direction (arrow A direction) of the sheet P is called fixing position Q.

A guide member 118 that supports the sheet P is provided between the transport belt 96 and the nip part N in the transport direction of the sheet P. Also, a guide member 119 that supports the sheet P is provided downstream of the nip part N in the transport direction of the sheet P.

Figure 6A:
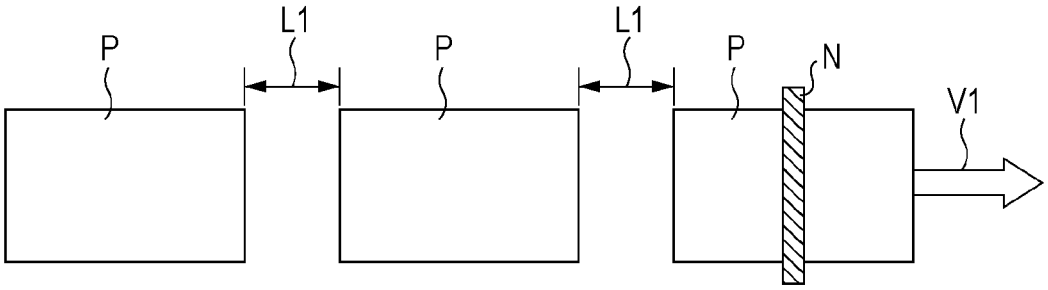
FIGS. 6A and 6B are explanatory views showing a state when a fixing speed and a transport interval are changed in the image forming apparatus according to the first exemplary embodiment.

In this exemplary embodiment, for example, the length in the transport direction of the sheet P to be transported is longer than the distance between the second transfer position TB and the fixing position Q. In this exemplary embodiment, as shown in FIG. 6A, the transport interval of the sheets P in a normal environment is L1.

Controller

The controller 20 shown in FIGS. 1 and 3 is formed as a computer that executes control and various calculations of the entire image forming apparatus 10. That is, the controller 20 includes a central processing unit (CPU), a read only memory (ROM) storing various programs, a random access memory (RAM) used when a program is executed, a non-volatile memory storing various information, and an input/output interface. The illustration of the CPU, ROM, RAM, non-volatile memory, and input/output interface is omitted.

Also, as described above, the controller 20 receives information, such as the type of the sheet P (basis weight, material, size, etc.), the number of image forming sheets, and execution or non-execution of duplex image formation, input with the operation panel 19. Further, the controller 20 has plural table (not shown) having ambient preset temperatures TS (not shown), each of which is the plural ambient temperature serving as the threshold for change of control and is set for each of respective types of sheets P.

The controller 20 sets (ambient preset temperature TS)=18 [° C.] for normal paper, coated paper, and an OHP sheet. Also, the controller 20 sets, for example, an ambient preset temperature TS higher than 18 [° C.] and an ambient preset temperature TS lower than 18 [° C.] in accordance with the basis weight. Alternatively, the ambient preset temperature TS may not be different in accordance with the basis weight. The ambient preset temperature TS may be different in accordance with the material or size of the sheet P.

In this exemplary embodiment, for example, (ambient preset temperature TS)=16 [° C.] is set if the basis weight is 177 [gsm] or larger, and (ambient preset temperature TS)=10 [° C.] is set if the basis weight is smaller than 177 [gsm]. The controller 20 selects the ambient preset temperature TS in accordance with the basis weight of the sheet P selected with the operation panel 19. The ambient preset temperature TS selected at this time is a selection temperature. Alternatively, the temperature of the ambient preset temperature TS may be set at a temperature different from these temperatures.

In addition, the controller 20 controls the operations of the transfer motor 89 and the fixing motor 107 so that the transfer speed and fixing speed are decreased as compared with those in the normal environment if the ambient temperature measured by the ambient temperature sensor 21 becomes a low temperature lower than the selected ambient preset temperature TS. It is assumed that the transfer speed and fixing speed in the normal environment is V1, and the transfer speed and fixing speed in a low-temperature environment is V2 (<V1). Further, the controller 20 controls the operation of the registration motor 39 in response to a decrease in the transfer speed and fixing speed, and decreases the transport interval L1 (see FIG. 6A) of the sheets P before the fixing to a transport interval L2 (see FIG. 6B).

By decreasing the transfer speed, the period for color correction by the image processor (not shown) based on the output of the image density sensor 77 (see FIG. 1) is ensured. Hence, in this exemplary embodiment, since the color correction is accurately executed even if the transport interval of sheets P is decreased, the transport interval is decreased from L1 to L2.

Fixing Lower-Limit Temperature and Fixation

Next, the fixing lower-limit temperature and fixation of the fixing device 100 are described.

Figure 4:
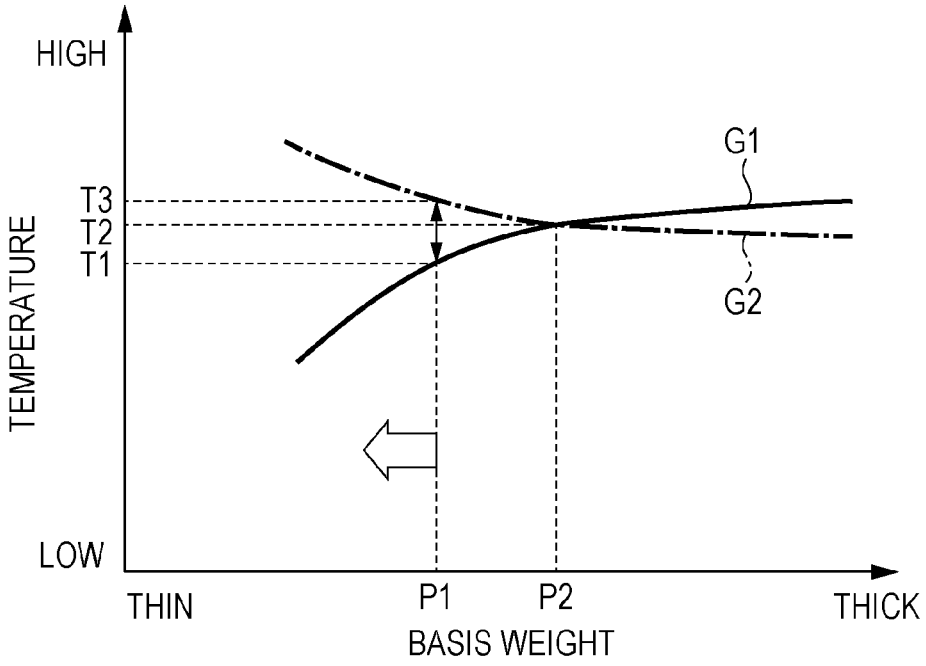
FIG. 4 is an explanatory view showing a fixing lower-limit temperature and a fixing temperature when the basis weight of a sheet is changed according to the first exemplary embodiment.

FIG. 4 shows the fixing lower-limit temperature (graph G1 indicated by solid line) and the fixing temperature (graph G2 indicated by a dotted-chain line) when the basis weight of the sheet P is changed. The basis weight is obtained by the measuring method for basis weight of JIS P-8124. Also, the unit of basis weight is [g/m$^2$]; however, the unit is written as [gsm] in the following description.

The fixing lower temperature is a fixing temperature that is the minimum requirement for the fixing belt 102 (see FIG. 2) to provide the fixation without any practical problem of the toner image TG to the sheet P after the fixing.

The fixing temperature represents the temperature of the fixing belt 102 when the toner image TG is fixed while plural sheets P are continuously transported (for example, 100 sheets P are transported per 1 minute) and heat is taken by the sheets P.

As shown in graph G1, the fixing lower-limit temperature is increased as the basis weight of the sheet P is increased (becomes thick). That is, as the thickness of the sheet P is increased, the amount of heat required for fixing the toner image TG is increased. The increase ratio of the fixing lower-limit temperature is large until a basis weight P2; however, the increase ratio is small for the basis weight P2 or larger.

As shown in graph G2, the fixing temperature is decreased as the basis weight of the sheet P is increased (becomes thick). That is, as the thickness of the sheet P is increased, the amount of heat absorbed by the fixing belt 102 is increased. The fixing temperature is decreased. The decrease ratio of the fixing temperature is large until the basis weight P2; however, the decrease ratio is small for the basis weight P2 or larger.

In FIG. 4, it is assumed that the intersection between graph G1 and graph G2 is the basis weight P2, and (fixing lower-limit temperature with basis weight P2)=(fixing temperature) =T2. Also, it is assumed that when P1 is a basis weight smaller than the basis weight P2, (fixing lower-limit temperature with basis weight P1)=T1, and T3 is the fixing temperature, T1<T2<T3 is established.

Herein, if the fixing temperature is the fixing lower-limit temperature or higher, the fixation does not have any practical problem. However, there is actually a measurement error in the temperature of the fixing belt 102, and hence even if the sheet P with the basis weight P2 satisfying (fixing temperature)=(fixing lower-limit temperature) is used, the fixation may not be ensured.

In contrast, if the sheet P with the basis weight P1 is used, there is a temperature margin (T3-T1). Hence, if the margin (T3-T1) becomes larger than the measurement error of the fixing temperature sensor 116 (see FIG. 3), the fixation is ensured.

Fixing Lower-Limit Temperature and Nip Width

Next, the relationship between the fixing lower-limit temperature and the nip width in the fixing device 100 is described.

Figure 5:
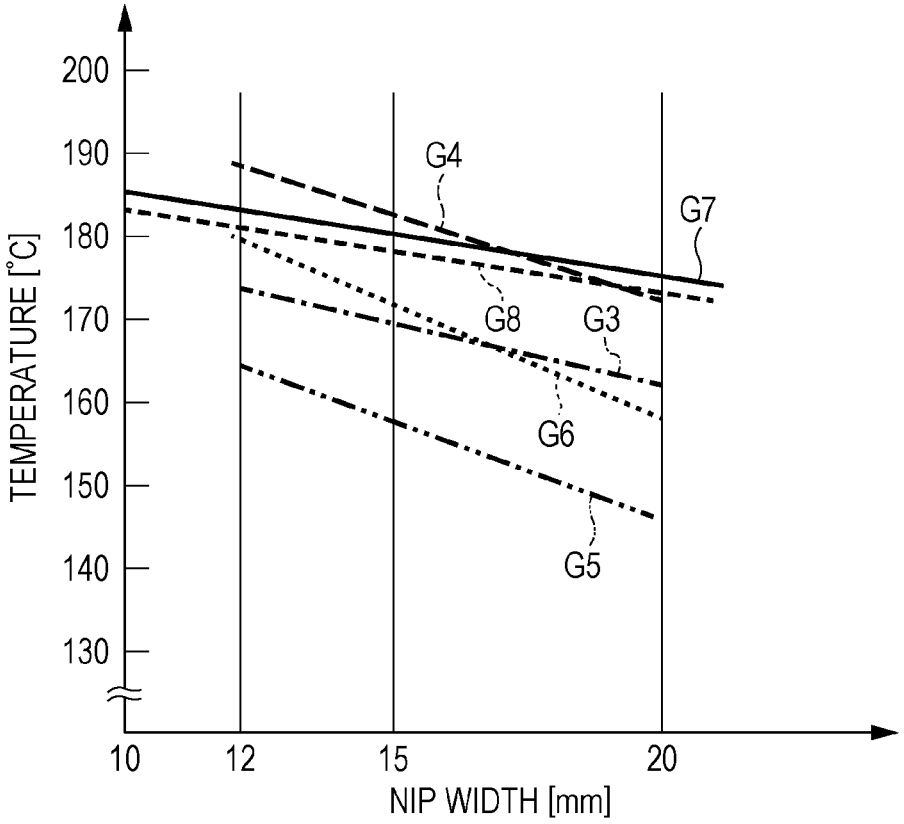
FIG. 5 is an explanatory view showing the fixing lower-limit temperature and the fixing temperature for sheets of sheet types A and B when the width of a nip part is different according to the first exemplary embodiment.

FIG. 5 shows respective temperatures when the nip width of the nip part N (see FIG. 2) is changed in the normal environment and the low-temperature environment for the fixing lower-limit temperature of a sheet type A and a sheet type B of sheets P and for the temperature of the fixing belt 102 (see FIG. 2). The sheet type A is, for example, Elite Gloss 300 [gsm] manufactured by Fuji Xerox Co., Ltd., and the sheet type B is, for example, OK topcoat 127 [gsm] manufactured by Oji Paper Co., Ltd. Also, in FIG. 5, the normal environment is an environment in which the ambient temperature is 22 [° C.] and the humidity is 55 [%], and the low-temperature environment is an environment in which the ambient temperature is 16 [° C.] and the humidity is 15 [%], for an example of conditions.

Graph G3 is the fixing lower-limit temperature of the sheet type A in the normal environment, and graph G4 is the fixing lower-limit temperature of the sheet type A in the low-temperature environment. Graph G5 is the fixing lower-limit temperature of the sheet type B in the normal environment, and graph G6 is the fixing lower-limit temperature of the sheet type B in the low-temperature environment. Graph G7 is the lowest temperature of the fixing belt 102 (see FIG. 2) after the toner image TG is fixed to the plural sheets P of the sheet type A while continuously transporting the sheets P and the heat is taken to the sheets P in the normal environment. Graph G8 is the lowest temperature of the fixing belt 102 after the toner image TG is fixed to the plural sheets P of the sheet type A while continuously transporting the sheets P and the heat is taken to the sheets P in the low-temperature environment.

In FIG. 5, if the fixing temperature of the fixing belt 102 is higher than the fixing lower-limit temperature of each sheet P in the normal environment and the low-temperature environment, the fixation is ensured. Herein, if the nip width is changed to, for example, 12 [mm], 15 [mm], and 20 [mm], the fixation for the sheet type B is ensured in the normal environment and the low-temperature environment. However, although the fixation of the sheet type A is ensured in the normal environment, the fixation is not ensured in the low-temperature environment (state in which graph G4 is located at the high-temperature side of graph G8).

A sheet type, such as the sheet type A, the fixation of which is not ensured in the low-temperature environment, the fixation is ensured if the fixing temperature of the fixing belt 102 is increased. However, if the heating temperature of the fixing belt 102 is simply increased to increase the lowest temperature of the fixing belt 102, the interface temperature of the core metal and the elastic layer in the pressure roller 104 is excessively increased, and as the result, the elastic layer may come off, or the curl amount of the sheet P may be increased. Hence, in this exemplary embodiment, when the low-temperature environment (the aforementioned ambient preset temperature TS or lower) is attained, the controller 20 decreases the fixing speed of the fixing belt 102, so that the heat amount given to the toner image TG is increased.

Operation

Next, the operation according to the first exemplary embodiment is described.

Operation of General Configuration

In the image forming apparatus 10 shown in FIG. 1, when an image is formed on a sheet P, the respective image holding members 62 are charged by the charging unit 72, and exposed to light with the light beams Bm emitted from the exposure units 66 in accordance with image data. Hence, electrostatic latent images are formed on the image holding members 62.

Then, the electrostatic latent images formed on the outer peripheral surfaces of the respective image holding members 62 are developed by the developing units 74 into toner images of the respective colors of yellow (Y), magenta (M), cyan (C), and black (K). Then, the toner images formed on the surfaces of the respective image holding members 62 are successively transferred on the intermediate transfer belt 82 at the first transfer positions TA in a superposed manner. Then, the toner images TG transferred in a superposed manner on the intermediate transfer belt 82 are second-transferred on a sheet P, which is transported through the transport path 30, at the second transfer position TB.

Then, the sheet P with the toner images TG transferred thereon is transported to the fixing device 100 by the transport belt 96. Then, in the fixing device 100, the toner images TG on the sheet P are fixed to the sheet P by applying heat and pressure. The sheet P with the toner images TG fixed thereto is output to, for example, the sheet output part 13. In this way, a series of image forming steps is executed. Meanwhile, if a toner image TG is formed on a non-image surface without an image (in the case of duplex image formation), the image is fixed on the front surface by the fixing device 100, then the sheet P is sent to the duplex transport path 31, and the image formation and fixing are executed on the back surface.

Operation of Major Section

In the image forming apparatus 10 shown in FIG. 1, the controller 20 selects the ambient preset temperature TS (not shown) in accordance with the type of the sheet P set with the operation panel 19 (see FIG. 3). If the ambient temperature measured by the ambient temperature sensor 21 is [° C.], the controller 20 recognizes the normal environment.

Then, when the image forming apparatus 10 starts the image forming operation, as shown in FIG. 6A, the controller 20 controls the transfer operation and fixing operation in the state of (transfer speed)=(fixing speed)=V1 and (transport interval of sheets P)=L1.

In contrast, in the image forming apparatus 10, if the ambient temperature measured by the ambient temperature sensor 21 is 16 [° C.] (lower than 18 [° C.]), the controller 20 recognizes the low-temperature environment.

Figure 7:
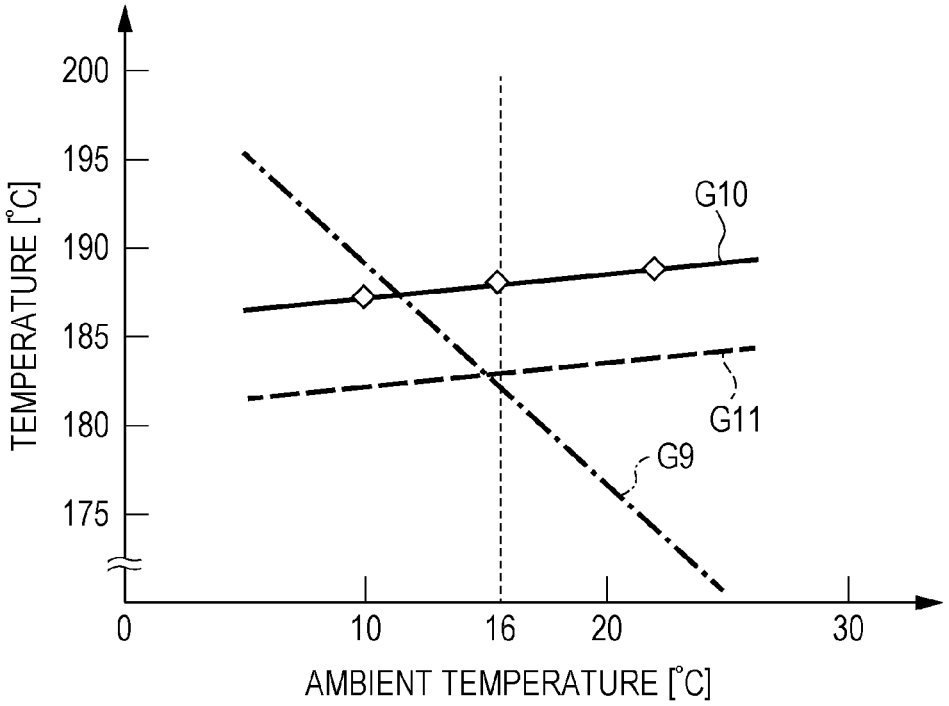
FIG. 7 is an explanatory view showing the fixing lower-limit temperature and the fixing temperature when the ambient temperature is changed according to the first exemplary embodiment.

FIG. 7 shows the fixing lower-limit temperature of a sheet P (for example, the aforementioned sheet type A) and the fixing temperature of the fixing belt 102 when the ambient temperature is changed. Specifically, graph G9 (dotted-chain line) in the drawing indicates the fixing lower-limit temperature, graph G10 (plot with diamond shapes and solid line) indicates the fixing temperature of the fixing belt 102, and graph G11 (broken line parallel to graph 10) indicates the temperature lower than the fixing temperature by 5 [° C.].

Figure 6B:
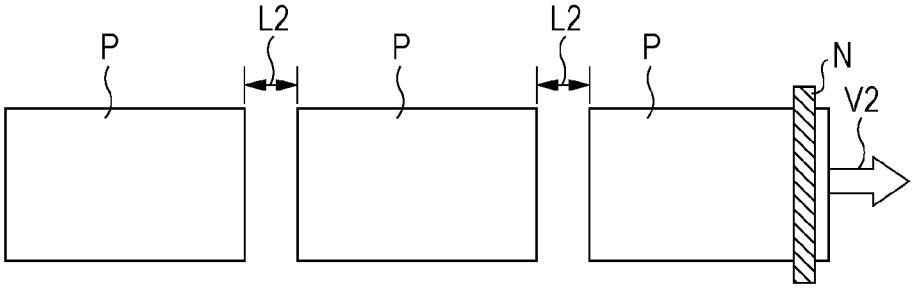

In FIG. 7, when the ambient temperature is 16 [° C.], the temperature of graph G9 and the temperature of graph G11 have very close values. The fixation with regard to the margin is barely enough for fixing. In this case, the controller 20 (see FIG. 3) causes the transfer operation and fixing operation to be executed in the state of (transfer speed)=(fixing speed)=V2 (<V1) as shown in FIG. 6B to increase the heat amount given to the toner image TG (see FIG. 2). Accordingly, the fixing temperature at the fixing belt 102 becomes higher than the fixing lower-limit temperature of the sheet P (for example, becomes higher by 5 [° C.] or more for the margin), and the fixation of the toner image TG to the sheet P in the low-temperature environment is ensured.

Further, the controller 20 changes the send interval of the sheets P to the second transfer position TB by the registration roller 38 shown in FIG. 1 so that (transport interval of sheets P)=L2 (<L1) is established in response to the change in the transfer speed and fixing speed. Accordingly, as shown in FIGS. 6A and 6B, in the low-temperature environment, the transfer speed and fixing speed are decreased; however, the number of image forming sheets per unit time (hereinafter, called productivity) becomes a value close to the productivity in the normal environment. The unit of the productivity is expressed by [sheets/minute]. In this way, in the image forming apparatus 10, a decrease in productivity in the low-temperature environment is restricted.

Herein, for example, when the productivity in the normal environment is compared with the productivity in the low-temperature environment, the result shown in FIG. 8 is obtained. The productivity under the condition that the environment is the normal environment and the basis weight of a sheet P is 300 [gsm] or smaller is 100 [sheets/minute] for normal paper, 100 [sheets/minute] for coated paper, and 40 [sheets/minute] for OHP sheets.

Also, as a comparative example, if the transport interval of sheets P in the low-temperature environment is not decreased, the productivity is as follows: 90 [sheets/minute] for normal paper, 70 [sheets/minute] for coated paper, and 35 [sheets/minute] for OHP sheets.

In contrast, in this exemplary embodiment, the productivity under the condition that the environment is the low-temperature environment and the basis weight of a sheet P is 176 [gsm] or smaller is 100 [sheets/minute] for normal paper, 100 [sheets/minute] for coated paper, and 40 [sheets/minute] for OHP sheets, by decreasing the transport interval. Further, the productivity under the condition that the environment is the low-temperature environment and the basis weight of a sheet P is in a range from 177 [gsm] to 300 [gsm] is 100 [sheets/minute] for normal paper, 80 [sheets/minute] for coated paper, and 40 [sheets/minute] for OHP sheets. As described above, with the image forming apparatus 10 according to this exemplary embodiment, it is found that the productivity close to the normal environment is obtained even in the low-temperature environment, as compared with the comparative example.

Also, in the image forming apparatus 10, the controller 20 selects the ambient preset temperature TS in accordance with the type of sheets P. For example, if the basis weight is large, a temperature higher than the normal ambient preset temperature TS is selected as the threshold, and if the basis weight is small, a temperature lower than the normal ambient preset temperature TS is selected as the threshold.

Accordingly, if a sheet P with a large basis weight (absorbing heat by a large heat amount) is used, the ambient preset temperature TS higher than the normal state is selected, and the transfer speed and fixing speed are decreased in an early phase when the ambient temperature is decreased. Accordingly, the heat amount required for fixing is obtained, and the fixation of the toner image TG is ensured.

In contrast, if a sheet P with a small basis weight (absorbing heat by a small heat amount) is used, the ambient preset temperature TS lower than the normal state is selected, and the transfer speed and fixing speed are decreased in a late phase when the ambient temperature is decreased. That is, the transfer speed and fixing speed are not decreased until the ambient temperature becomes lower than the normal ambient preset temperature TS. Hence, the decrease in productivity in the low-temperature environment is restricted.

Second Exemplary Embodiment

Next, an example of an image forming apparatus according to a second exemplary embodiment is described. The same reference sign is applied to the basically same member or portion as that of the first exemplary embodiment, and the description is omitted.

Figure 9:
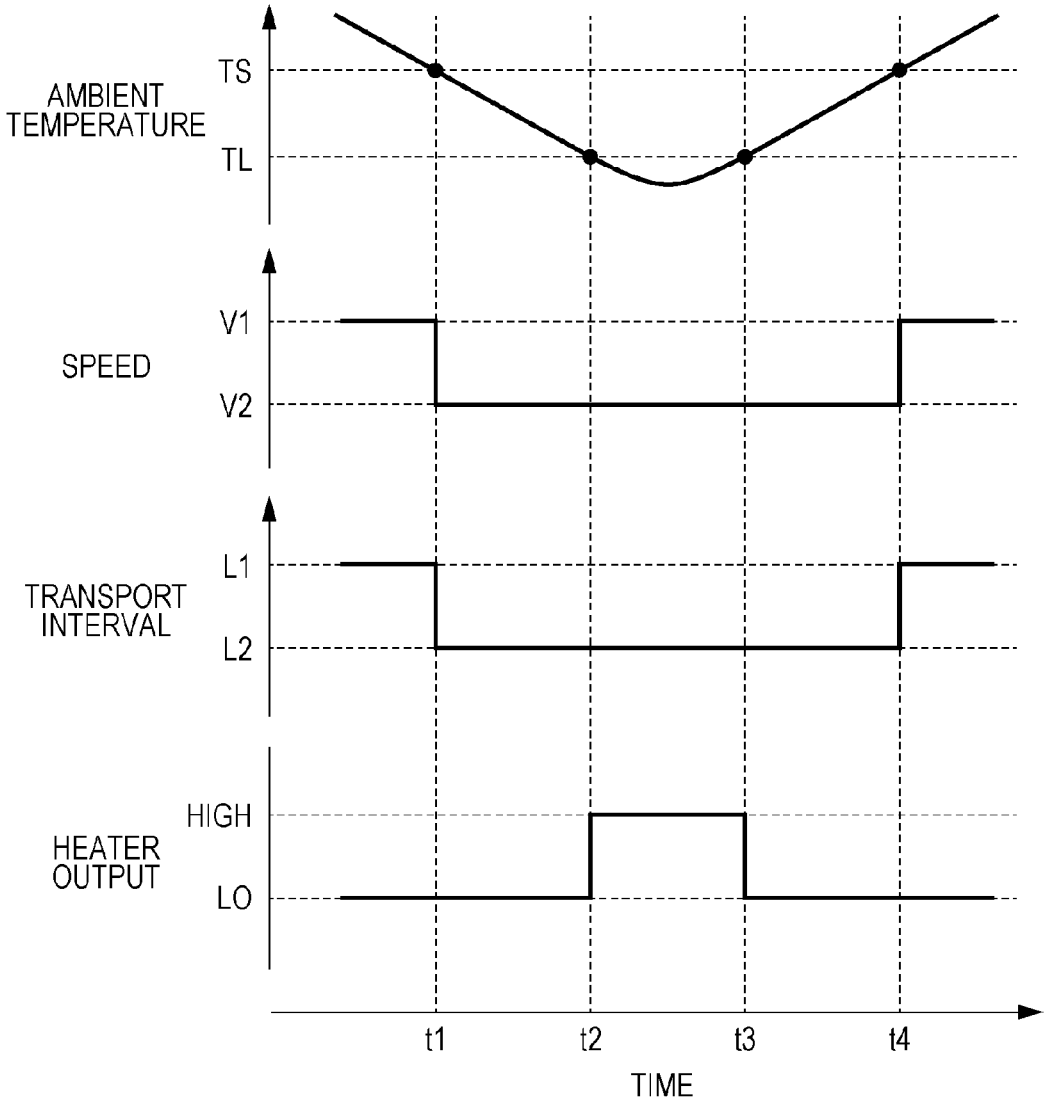
FIG. 9 is an explanatory view showing the speed, sheet interval, and control condition of heater output when the ambient temperature is changed in the image forming apparatus according to the second exemplary embodiment.

As shown in FIG. 9, an image forming apparatus 10 according to the second exemplary embodiment is similar to the first exemplary embodiment in that the speed (transfer speed and fixing speed) is changed to V1 or V2 and the transport interval is changed to L1 or L2 while the ambient preset temperature TS (ambient temperature) serves as the threshold.

However, the image forming apparatus 10 according to the second exemplary embodiment is different from the first exemplary embodiment in that an ambient lower-limit temperature TL lower than the ambient preset temperature TS is set, and the heater output (output of the fixing heater 114 (see FIG. 3)) is changed to L0 or HIGH while the ambient lower-limit temperature TL serves as the threshold.

Operation

Next, the operation according to the second exemplary embodiment is described. FIGS. 1, 2, and 3 are referenced for respective members and parts, and description of reference signs for the respective members is omitted.

In FIG. 9, assuming that times are t1<t2<t3<t4, the ambient temperature is TS at time t1, is TL at time t2 and time t3, and is TS at time t4. The speed (transfer speed and fixing speed) is decreased from V1 to V2 at time t1, is V2 from t1 to t4, and is increased from V2 to V1 at time t4. The transport interval is decreased from L1 to L2 at time t1, is L2 from time t1 to time t4, and is increased from L2 to L1 at time t4. The heater output is L0 until time t2, is increased from L0 to HIGH at time t2, is HIGH until time t3, is decreased from HIGH to L0 at time t3, and is L0 at time t4.

That is, in the image forming apparatus 10 according to the second exemplary embodiment, if the ambient temperature measured by the ambient temperature sensor 21 becomes lower than the ambient preset temperature TS, the transfer speed and fixing speed are decreased from V1 to V2, and the transport interval is decreased from L1 to L2. Herein, if the ambient temperature becomes the ambient lower-limit temperature TL or lower (from time t2 to time t3), the controller 20 increases the output of the fixing heater 114. Accordingly, since the fixing temperature of the fixing belt 102 is increased, the fixation of the toner image TG is ensured. Further, since the transport interval is decreased to L2, the decrease in productivity is restricted.

Also, in the image forming apparatus 10 according to the second exemplary embodiment, the output of the fixing heater 114 is restricted until the ambient temperature becomes the ambient lower-limit temperature TL, and the output of the fixing heater 114 is increased when the ambient temperature becomes the ambient lower-limit temperature TL or lower. Accordingly, in the pressure roller 104, the phenomenon in which the temperature of the interface between the core metal and the elastic layer is excessively increased is restricted, and the elastic layer is restricted from coming off. Also, an excessive increase in temperature of the fixing belt 102 is restricted, and the curl amount of the sheet P after the fixing is restricted from being increased.

The present invention is not limited to the above-described exemplary embodiments.

Modification

Figure 10:
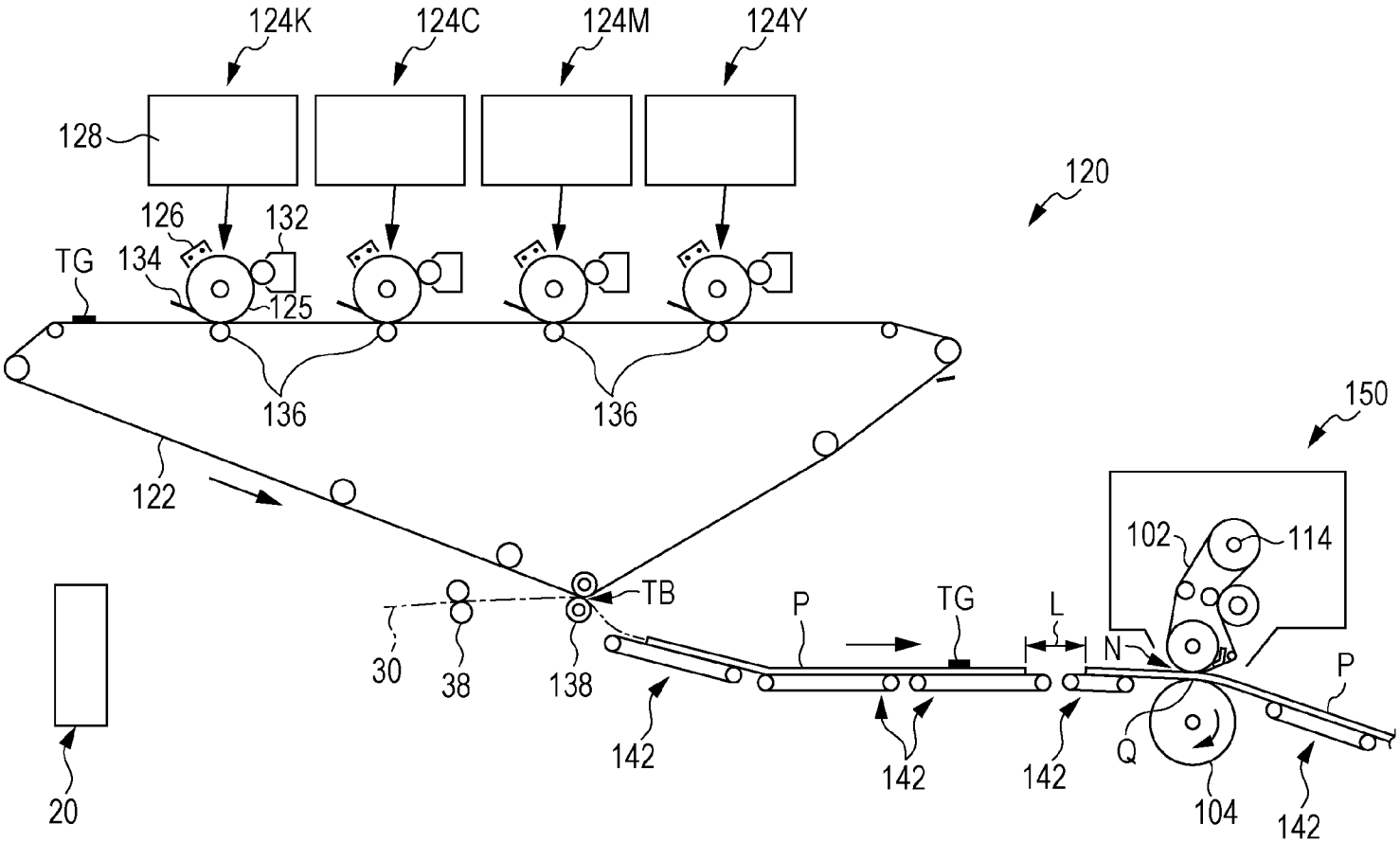
FIG. 10 is a configuration diagram of an image forming apparatus according to a modification.

FIG. 10 shows an image forming apparatus 120 as a modification of the image forming apparatus 10. The image forming apparatus 120 includes four image forming units 124Y, 124M, 124C, and 124K that form toner images TG on an intermediate transfer belt 122 that moves in a circulation manner. The image forming units 124Y, 124M, 124C, and 124K each have a photoconductor 125, a charging unit 126 that charges the photoconductor 125, an exposure device 128 that performs exposure to light, a developing unit 132 that performs development with a toner, and a cleaning blade 134 that cleans the photoconductor 125.

Also, the image forming apparatus 120 includes first transfer rollers 136 that transfer the toner images TG on the intermediate transfer belt 122 from the photoconductors 125, and a second transfer roller 138 that second-transfers the toner images TG from the intermediate transfer belt 122 on a sheet P. The position at which the toner images TG are transferred on the sheet P by the second transfer roller 138 is a second transfer position TB. The second transfer position TB is on a transport path 30, and a registration roller 38 is provided on the transport path 30.

Further, the image forming apparatus 120 includes plural transport units 142, as an example of a transport unit that transports a sheet P; a fixing device 150 as an example of a fixing unit that fixes the toner images TG to the sheet P transported by the transport unit 142, and the above-described controller 20. In addition, the image forming apparatus 120 includes the operation panel 19 (see FIG. 3), respective sensors, and respective motors described in the first exemplary embodiment. The transport unit 142 has a configuration in which a belt is wound around two rollers and the belt is movable in a circulation manner.

The fixing device 150 includes a fixing belt 102 wound around plural rollers, a pressure roller 104 that presses the sheet P, and a fixing heater 114 that heats the fixing belt 102. The center position of a nip part N in the transport direction of the sheet P is called fixing position Q. Also, in the image forming apparatus 120, for example, the length in the transport direction of the sheet P to be transported is smaller than the distance between the second transfer position TB and the fixing position Q. Further, in the normal environment, the transport interval of the sheets P is L.

In the image forming apparatus 120, when the ambient temperature becomes lower than the preset temperature, the fixing speed is decreased and the transport interval is set to be smaller than L by the control of the controller 20. Herein, in the image forming apparatus 120, since the sheet P is not arranged at both the second transfer position TB and the fixing position Q, the transfer speed and fixing speed may be independently set without being affected by the condition of the sheet P (bend or other condition). Accordingly, in the image forming apparatus 120, the transfer speed, fixing speed, and transport interval are freely combined.

Other Modification

The transport unit is not limited to a belt-type transport unit, such as the transport unit 90 and the transport unit 142, and may be a roller type. Also, if the transfer speed and fixing speed are independently set similarly to the aforementioned modification, instead of the registration roller 38, control of changing the transport interval L may be executed by the transport unit 142.

The fixing unit is desirably a belt-type fixing device to increase the nip width; however, the fixing unit may be a roller-type fixing device that applies heat and pressure by a pair of rollers. Also, the fixing heater 114 is not limited to the halogen lamp, and may use an exothermic element that generates heat when being energized. Further, the fixing heater 114 may be electromagnetic induction type that causes a heat generating layer of the fixing belt 102 to generate heat by an electromagnetic induction effect of the magnetic field of a coil generated when being energized.

The temperature measuring unit is not limited to the configuration that directly measures the temperature outside the image forming apparatus 10 (exterior). The temperature measuring unit may be an indirect measurement type configuration that is arranged in the apparatus body 11 and the temperature measured in the apparatus body 11 is corrected to the ambient temperature by using a correlation function etc.

The speed changing unit and the interval changing unit do not have to be a single unit such as the controller 20, and may be formed of different controllers.

The setting of the ambient preset temperature TS and the productivity of image formation are not limited to the above-described cases, and may employ other setting. For example, if the ambient temperature becomes 15 [° C.], the fixing speed may be decreased by 70 [mm/s] from the fixing speed in the normal environment, the transport interval may be changed from 60 [mm] to 50 [mm], and the productivity may be changed from 90 [sheets/minute] to 70 [sheets/minute]. Further, values different from these values may be set. Also, without limiting to the control in which the respective speeds are decreased and the transport interval is decreased if the ambient temperature becomes the ambient preset temperature TS or lower, the control may be executed if the ambient temperature becomes lower than the ambient preset temperature TS. In this case, the controller 20 executes control of increasing the respective speeds and increasing the transport interval as compared with the low-temperature environment if the ambient temperature becomes the ambient preset temperature TS or higher (or higher than TS).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transport unit configured to transport a plurality of recording media having developer images transferred thereon, at a set distance between successive ones of the plurality of recording media;

a fixing unit configured to fix the developer images to the recording media transported by the transport unit, by applying heat;

a temperature measuring unit configured to measure an ambient temperature;

a speed changing unit configured to decrease a fixing speed of the developer images in the fixing unit if the ambient temperature measured by the temperature measuring unit is a preset temperature or lower; and an interval changing unit configured to decrease the set distance if the ambient temperature is the preset temperature or lower.

2. The image forming apparatus according to claim 1, wherein the preset temperature includes a plurality of preset temperatures, each of which is set in accordance with a type of the recording media, and wherein the speed changing unit selects a selection temperature that is one of the plurality of preset temperatures, in accordance with the type of the recording media, and decreases the fixing speed if the ambient temperature is the selection temperature or lower.

3. The image forming apparatus according to claim 1, wherein a temperature lower than the preset temperature is set, and wherein the fixing unit increases a fixing temperature if the ambient temperature measured by the temperature measuring unit is the temperature, which is lower than the preset temperature, or lower.

4. An image forming method comprising:

transporting a plurality of recording media having developer images transferred thereon, at a set distance between successive ones of the plurality of recording media;

fixing the developer images to the transported recording media by applying heat;

measuring an ambient temperature;

decreasing a fixing speed of the developer images in the fixing if the measured ambient temperature is a preset temperature or lower; and decreasing the set distance if the ambient temperature is the preset temperature or lower.

5. An image forming apparatus comprising:

a transport device comprising a support roller, a driving roller, and a transport belt, wherein the transport device is configured to transport a plurality of recording media having developer images transferred thereon, at a set distance between successive ones of the plurality of recording media;

a fixing device comprising a fixing belt and a pressure roller configured to fix the developer images to the recording media transported by the transport device, by applying heat;

an ambient temperature sensor configured to measure an ambient temperature; and at least one processor configured to decrease a fixing speed of the developer images in the fixing device if the ambient temperature measured by the ambient temperature sensor is a preset temperature or lower, wherein the at least one processor is configured to decrease the set distance if the ambient temperature is the preset temperature or lower.

* * * * *